United States Patent [19]

Guelden

[11] 4,408,819

[45] Oct. 11, 1983

[54] ELECTRICAL ADAPTER WITH SNAP-FITTED JACK AND HOOD

[75] Inventor: Ronald H. Guelden, Shreveport, La.

[73] Assignee: Western Electric Company, Incorporated, New York, N.Y.

[21] Appl. No.: 352,497

[22] Filed: Feb. 25, 1982

[51] Int. Cl.[3] ..... H01R 13/506; H01R 27/02

[52] U.S. Cl. ..... 339/154 A; 179/178; 339/91 R

[58] Field of Search ..... 179/1 PC; 339/154 A, 339/91 R, 176 M, 210 M

[56] References Cited

U.S. PATENT DOCUMENTS

| | | | |
|---|---|---|---|
| 4,070,548 | 1/1978 | Kasper | 179/1 PC |
| 4,203,643 | 5/1980 | Krolaic et al. | 339/91 R X |
| 4,239,317 | 12/1980 | Hesse et al. | 339/91 R |
| 4,239,320 | 12/1980 | Hesse et al. | 339/154 A |
| 4,290,664 | 9/1981 | Davis et al. | 179/1 PC X |

OTHER PUBLICATIONS

"Adapter", R. H. Guelden, Western Electric Technical Digest, No. 58, 4–1980, p. 17.

*Primary Examiner*—Eugene F. Desmond
*Attorney, Agent, or Firm*—R. F. Kip, Jr.

[57] ABSTRACT

The invention relates to an improvement in an electrical telecommunications adapter (20) for coupling the terminating plug of a telephone set to appropriate wires of a 25-pair telephone distribution cable, the adapter comprising a 50-pin connector (21) of which the pins are adapted to be coupled to fixed contacts in turn coupled to such wires, a hood (22) for the connector and a jack (23) disposed in said hood and adapted to receive such plug. The improvement involves a structure for coupling the jack and hood, the structure comprising vertical slots (55) formed in the sidewalls (37) of the hood and corresponding vertical ribs (60) formed on the transversely opposite sides of the jack, such ribs being adapted by resilient spreading and subsequent restoration of sidewalls (37), to enter into such slots and provide a snap-fit between the jack and hood.

10 Claims, 7 Drawing Figures

ELECTRICAL ADAPTER WITH SNAP-FITTED JACK AND HOOD

TECHNICAL FIELD

The invention relates generally to electrical adapters for coupling the terminating plug of a telephone set to a connector coupled with the wires of a distribution cable, such adapter comprising a connector adapted to mate with such first named connector, a connector hood and a jack for receiving such plug. More particularly, this invention relates to an improved mode in such an adapted for coupling together its jack and its hood.

BACKGROUND OF THE INVENTION

It is common for telephone sets in a business office to be coupled to the telephone network via a 25-pair distribution cable installed in the office. Modern telephone sets, however, are designed to be electrically connected up through the telephone cords and plugs which include a substantially lesser number of electrical conductors than those contained in the cable. For example, as compared to the 25 pairs of wire in the cable, some business telephone sets have a two-pair cord and a corresponding plug with four spring contacts, while others, have a three-pair cord terminating in a six-contact plug. Evidently, to try to electrically connect seriatim the four or six lead-in wires of such a set to the appropriate wires of the 25-pair cable would be unduly expensive and time consuming. This is particularly true when the telephone set is replaced from time to time by a new set which is either the same or different model. Therefore, it is usual for the coupling of the set to the cable to be accomplished by the use of devices known as adapters which are mounted in installed adapter blocks, and which, on the one hand, receive the plug of the set and, on the other hand, are coupled through their connector through a connector included in the adapter block to the conductors in the cable so as to permit, by simply inserting the plug of the set into the jack of the adapter, a connecting up of the telephone set to the cable and, thus, to the telephone network.

An adapter of such kind for coupling sets with two-pair or three-pair cords terminating in four-contact or six-contact plugs is disclosed on page 17 of the April 1980 issue of the *Technical Digest,* a publication of Western Electric Company, Incorporated. The disclosed adapter comprises a horizontal 50 pin connector, adapted to make with a connector in an adapter block, a hood for the connector and a jack received within the hood. The hood has an upside-down "U" shape in transverse cross section and terminates at its forward end in a vertical front opening of the same shape. The jack comprises a housing, a plug-receiving passage extending in such housing from its front towards its back, and spring contacts located at the rear of the passage.

For the purpose of receiving and maintaining the jack within the hood, the latter's upside-down "U" opening is bordered by two small vertical ridges projecting transversely inwards towards each other from the sidewalls of the hood, and the jack housing has two corresponding vertical grooves formed on its transversely opposite planar side walls. To fit the jack in the hood, the former is placed below the latter so as to vertically align the grooves in the jack housing with the ridges in the hood. The jack is then moved up with its grooves slidably receiving and sliding past such ridges until the jack reaches its final position inside the hood. Next, the hood is fastened at its forward end to the 50-pin connector by forcing locking tabs on the bottoms of the sidewalls of the hood past locking shoulders on the connector to snap mount the hood on the connector. When this is done, a flange on the connector projects outwardly beneath the bottom of the jack to prevent the jack from falling out of the hood.

When grooves are formed, as described, in the transversely opposite sides of the jack, the side walls of the jack housing must compensatingly be made transversely thicker in order for the housing to have the same mechanical strength as it would in the absence of such grooves. To put it another way, because of the previously used ridge-groove mode of securing the hack to the hood, the interior space within the jack housing cannot be transversely widened without sacrificing the mechanical integrity of the jack except by transversely widening the jack housing and, concomitantly, the transverse cross section of the good within which the jack is received. On the other hand, there are now models of key telephone sets which use four-pair cords and plugs with eight contacts so as to require eight contacts in the adapter jack, and to accommodate those eight jack contacts, the plug-receiving passage therein must commensurately be widened. If, however, in order to permit such passage's widening, the exterior of the jack's housing is transversely widened with the accompanying necessary transverse widening of the hood, then the adapter will not fit in the standard block which is used to mount the adapter in offices and which is already installed in many of them.

Accordingly, the adapter described in the mentioned *Technical Digest* article cannot conveniently be constructed so as to include a jack modified to have eight contacts and so as, at the same time, be dimensioned to still fit in a standard adapter block.

SUMMARY OF THE INVENTION

For the purpose among others of overcoming the disadvantage just mentioned in the kind of adapter disclosed in the mentioned *Technical Digest* article, there is provided an improvement in accordance with the invention as follows. The jack housing is provided with projections on its transversely opposite sides, and the hood is provided, rearward of its front opening and above its bottom, with corresponding receptacles for such projections. The jack is insertable into the hood by positioning the jack below the hood with the jack projections being in vertical alignment with the receptacles formed in the hood. Then, the jack is wedged up into the hood to spread its walls apart until the projections of the jack enter into such receptacles. At the point, the hood's sidewalls spring back towards each other to produce a snap fitting together of the jack and hood.

Such mode of securing the jack to the hood is capable of providing the advantage among others that, since it eliminates the previously described grooves in the jack housing, the plug-receiving passage in such housing may be widened to accommodate eight spring contacts therein while, concurrently, the exterior of the jack housing need not be widened for the purpose of maintaining adequate mechanical strength of the housing. The result is that, even though the jack may now have an increased number of contact springs therein, the hood may still have the same width as before such that the adapter can be mounted on an installed standard adapter block.

BRIEF DESCRIPTION OF THE DRAWINGS

For a better understanding of the invention, reference is made to the following description of a representative embodiment thereof, and to the accompanying drawings wherein.

Figure 1:
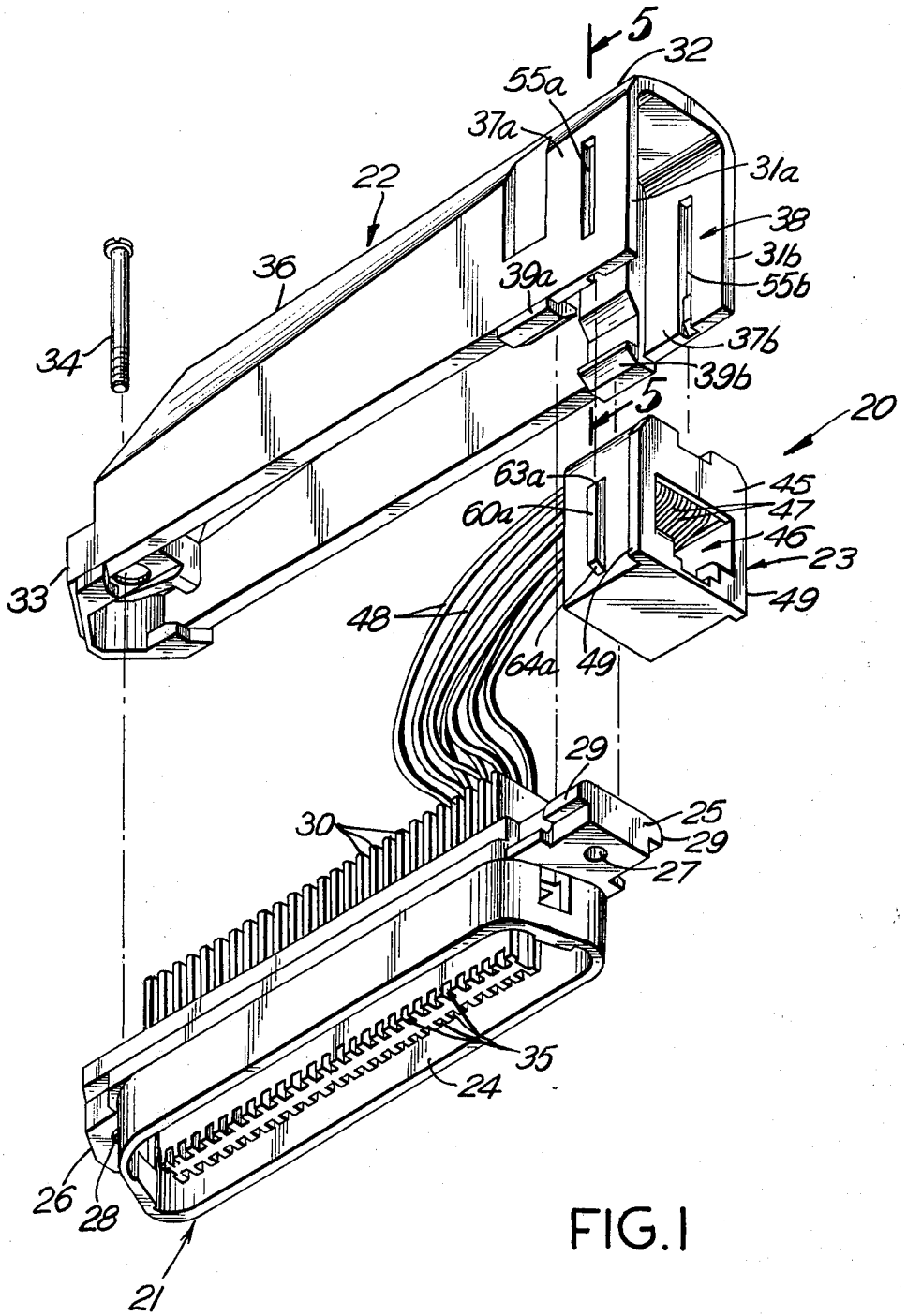
FIG. 1 is a perspective view of an improved adapter according to the invention in which the adpater is shown in unassembled form.

In the description hereinafter, a description of any element identified by a reference numeral and associated alphabetical or other suffix is to be taken, unless the context otherwise requires, as applying equally to any other element identified by the same reference numeral but by a different suffix following such numeral. Also, while the exemplary adapter is, for convenience, described and claimed herein as having a particular spatial orientation, the invention of which such adapter is a representative embodiment is not restricted to any particular spatial orientation of any embodiment thereof.

STRUCTURE

Referring now to FIG. 1, the reference numeral 20 designates an exemplary electrical telecommunications adapter according to the invention and comprising a connector 21, a hood 22 and a jack 23. The connector 21 is a 50-pin connector of a type commercially available from, for example, the Cinch Division of TRW Corporation, and from other suppliers as well. The connector is horizontally disposed in normal use and has a body 24 of synthetic resinous material in the form of a longitudinally elongated rectangle with rounded ends from which longitudinally project, respectively, rear and front mounting flanges 25 and 26 having, respectively, vertical holes 27 and 28 therein. The front flange 25 has formed on its tranversely opposite sides at its top a pair of transversely projecting locking shoulder 29. When the adapter is installed, the pins 30 of the connector 21 are respectively coupled electrically by the lower ends 35 to contacts of a mating connector (not shown) which is carried by an adapter block (not shown), those contacts being in turn coupled to the wires of a 25-pair telephone distribution cable (not shown).

The hood 22 is longitudinally elongated member of synthetic resinous material and adapted to be disposed over connector 21 with the forward end 32 of the hood being pressed down in use on the connector, and with the hood's back end 33 being coupled to the connector by the shown screw 34 which passes vertically through a hole in such back end and then through hole 28 in the connector's rear mounting flange 26. That screw and another screw (not shown) are utilized to mount the assembled adapter 20 on an installed adapter block (not shown), the other screw being passed for that purpose down through hole 26 in the connector's front flange 25.

The hood 22 is of upside-down "U" shape in transverse cross section so as to have an interior open at its bottom and to enclose such interior by a top wall 36 and resilient sidewalls 37*a*, 37*b*. All those walls terminate at the forward end 32 of the hood in a front opening 38 therefor which lies in a transverse vertical plane and is of the mentioned upside-down "U" shape and is flanked on either side by end faces 31*a*, 31*b* of the hood's side walls 37*a*, 37*b*. To the rear of such opening, the hood has at its bottom a pair of locking tabs 39*a*, 39*b* projecting transversely inward towards each other from the bottoms of sidewalls 37*a*, 37*b*, such tabs being adapted to engage with the shoulders 29 at the front end of the connector.

The jack 23 comprises a housing 45 of synthetic resinous material block, a passage 46 formed in the front of such housing for reception of a plug (not shown) terminating the cord of a telephone set, and spring contacts 47 mounted in the rear of such passage and adapted to the respectively engaged by the corresponding electrical contacts included in that plug. The contacts 47 of jack 23 are wired via respective insulated electrical leads 48 to appropriate ones of the pins 30 in connector 21 so as, when adapter 20 is assembled, mounted and installed and, also, the mentioned plug is inserted in the jack, the telephone set will be electrically connected to appropriate ones of the conductors in a 25-pair installed distribution cable and, thus, to the telephone network. When the adapter is in assembled condition, the jack 23 is fitted in hood 22 between the latter's sidewalls such that the jack is, for the most part, to the rear of the hood's front opening 38. To facilitate insertion of the jack into the hood, the jack housing 45 has, at its very front a pair of vertical guide flanges 49 projecting transversely outward from the transversely opposite sides of the housing and adapted to engage on either side of the hood's front opening 38 with the front end faces 37 on such sides of the resilient sidewalls 37 of the hood.

As so far described, the adapter 20 is known to the prior art. Turning now to some of the differences thereof from the previous adapter disclosed in the mentioned Technical Digest article and in which the plug receiving passage of the jack is only wide enough to permit four or six jack contacts to be fitted thereinto, in adapter 20, the passage 46 in jack 23 is transversely widened to accommodate therein the eight jack contacts necessary for connecting up certain of the newer key telephone sets. That tranverse widening of passage 46 would, if the jack housing is to be kept the same as before, tend to reduce the thickness of the walls provided by the housing between its plug-receiving passage and the housing's tranversely opposite exterior surfaces so as, thereby, to decrease the mechanical strength of the housing. An obvious alternative for permitting widening of such passage while avoiding reduction of such strength would be to increase the transverse dimension of the jack housing by the amount of such passage widening and to correspondingly increase the transverse dimension of the hood between the exterior surfaces of its sidewalls 37 while keeping the thickness of those walls constant so as to avoid loss in the mechanical strength of the hood. If such alternative were to be adopted, however, the increased transverse dimension of the hood would preclude the adapter 20 from being mounted in the standard installed mounting block for adapters of such kind.

By utilizing, however, an improvement in structure according to the invention which eliminates the aforedescribed grooves previously formed in the transverse sides of the jack housing and thus makes available the transverse space previously taken up by those grooves, the jack passage 46 may be widened to accommodate eight jack contacts without being necessarily accompanied by one or both of a loss in the mechanical strength of the jack housing or hood or an increase in the transverse dimension of the jack hood precluding mounting of the adapter in a standard block. All this is make possible according to the invention by an improved mode of fitting the jack to the hood as follows.

Figure 5:
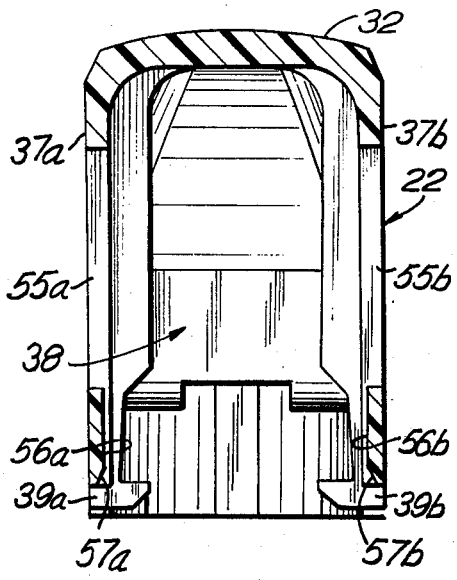
FIG. 5 is a cross-sectional view, taken as indicated by the arrows 5—5 in FIG. 1, of the hood of the adapter as shown in FIG. 1.
Figure 5A:
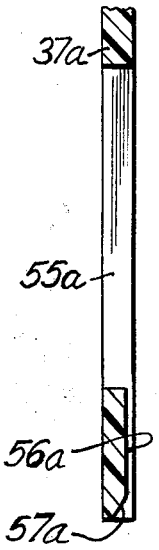
FIG. 5A is an enlarged part of the cross-sectional view of the FIG. 5 hood.
Figure 6:
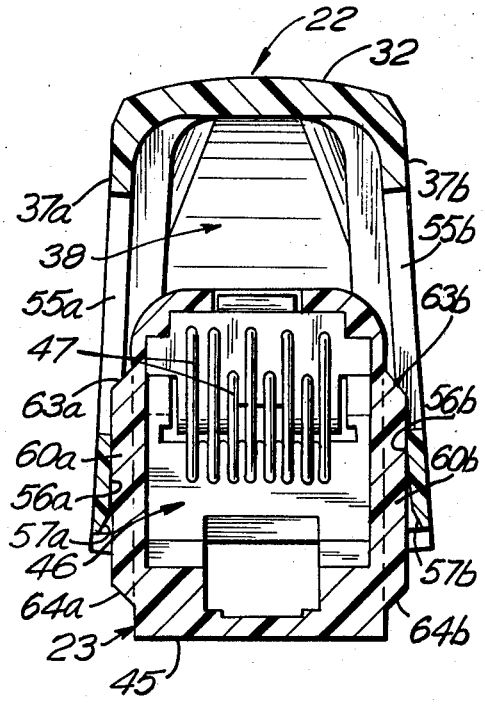
FIG. 6 is a cross-sectional view, taken as indicated by the arrows 6—6 in FIG. 2 of the jack and hood of the adapter when the former has been partly inserted into the latter in the course of snap fitting the jack and the hood together.

To effect such fitting, the sidewalls 37*a*, 37*b* of the hood 22 have formed therein respective receptacles 55*a*, 55*b* (FIGS. 1 and 5) which are disposed above the hood's bottom rearward of its opening 38, and which are preferably but not necessarily in the form of vertical slots passing transversely through such sidewalls. Extending between the lower ends of those slots and the bottoms of walls 37*a*, 37*b* are a pair of guide grooves 56*a*, 56*b* formed on the insides of those walls and sufficiently shallow in depth as to have no significant effect on the strength of such walls. The bottom opening of groove 56*a* is (FIG. 5A) rendered transversely outward flaring by providing the inner surface of such groove with a bottom extent 57*a* terminating at such opening and inclined to the vertical to impart to the transverse width of such groove a taper over such extent which is divergent in the downward direction. Extent 57*a* may be, as shown, a beveled face forming part of the groove's inner surface. The groove 56*b* is similarly shaped to have an inclined bottom extent 57*b* which likewise may be provided by a beveled face forming part of the inner surface of the groove.

The slots or other receptacles 55 in the hood are adapted to receive projections 60*a*, 60*b* on jack 23 which are on transversely opposite sides of its housing 24 so as to extend transversely outward from the housings's planar exterior surface areas 61*a*, 61*b* disposed on such sides and adapted to be enclosed within the hood 22 when the jack is properly fitted thereinto. The projections 60 are so located rearward of the front of the jack housing and above its bottom that, upon the jack being so fitted within the hood, the projections will enter into the hood's receptacles 55.

Preferably but not necessarily, the jack projections are in the form of vertical ribs having a width less than that of slots 55 only by a clearance amount permitting an easy fit of the ribs into the slots. The vertical length of the ribs is no more than will permit such an easy fit and may be, as shown, somewhat smaller. The thickness of ribs 60*a*, 60*b* measured from their outer surfaces 62*a*, 62*b* to the housing's surface areas 61*a*, 61*b* from which they project, is preferably approximately the same as the thickness of the sidewalls 37 of the hood and, thus, of the slots 55 formed in such sidewalls. At their tops, the ribs 60*a*, 60*b* have beveled faces 63*a*, 63*b* slanting upwardly and inwardly from the outer surfaces 62*a*, 62*b* of the ribs to the housing surface areas 61*a*, 61*b*. Likewise at their bottoms, the ribs 60*a*, 60*b* have beveled faces 64*a*, 64*b* extending downwardly and inwardly from such surfaces 62*a*, 62*b* to such surface areas 61*a*, 61*b*. As later explained, the beveled faces 63*a*, 64*b* of the ribs are adapted to act as wedging faces.

It will be noted that the exterior surfaces area 61 on the transversely opposite sides of the jack housing 45 are, over the longitudinal extent of the plug-receiving passage 46 from its front to contacts 47 therein, free of any grooves or other indentations which would diminish the thickness over such extent of the walls provided by the housing between such passage and the housing's transversely opposite sides. By virtue of the absence of such indentations, such passage may be widened to accomodate at least eight spring contacts 47 therein (as shown ) without incurring any loss over such extent in the strength of such walls as compared to the strength thereof in the previous adapter disclosed in the mentioned *Technical Digest* article.

USE OF THE IMPROVEMENT

The improved jack and hood are assembled together in a manner as follows. With the hood 22 being entirely separated from the connector as shown in FIG. 1, or with the forward end 32 of the hood being lifted away from the connector and the hoods back end 33 being loosely coupled thereto by screw 34, the jack is placed beneath the hood so that the jack ribs 60 are, as best as can be judged by eye, aligned to be approximately in vertical alignment with the slots 55 in the hood. The top of the jack is then brought into initial engagement with the bottom of the hood in such manner that the upper ends of the vertical guide flanges 49 at the jack's front are brought into sliding contact with the end faces 31 on the hood. By so doing, the ribs on the jack are longitudinally referenced to the slots in the hood to be properly centered with respect thereto in the longitudinal direction. Simultaneously, the upper beveled faces 63 on the ribs of the jack contact the beveled faces 57 at the bottoms of the guide grooves 56 on the inside of the hood 22.

Subsequent to such initial contact and with the sliding contact between the mentioned flanges 49 and end faces 31 being maintained, the jack is forcibly pressed further up into the hood. During such step, the jack, if it was not before centered in the hood, is transversely shifted in the course of its upward movement by the engagement of its ribs with beveled faces 57 of the hood's guide grooves 56 so as to become thus centered. Accordingly, and because of the guiding effect of those faces 57 and the guiding effect of the sliding contact between the flanges 49 and the end faces 31, the top of the jack may be entered into the hood without requiring an exact beforehand alignment by eye of the jack and hood when separated, and without suffering the wastage of time which would be involved in attempting to achieve such exact eye alignment.

Figure 2:
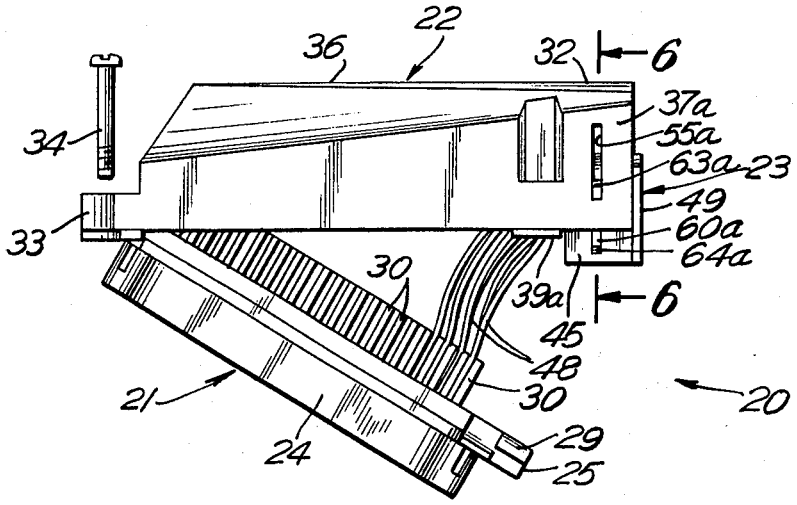
FIG. 2 is a front elevation of the FIG. 1 adapter in assembled form to the extent that its jack has been partly inserted into its hood in the course of snap-fitting the jack to the hood.

Another effect of the upward movement of the jack into the hood is that the bevel faces 63 on top of the jack's ribs wedge apart the resilient sidewalls 37 of the hood so as to permit further upward passage of the jack. Once those walls have been so spread, the jack is driven further up with the ribs 60 being slidingly received in the hood's inside grooves 56 which serve to guide the jack in its upwad movement so that manually pressing the jack's flanges 49 against the hood's end faces 31 need no longer be relied on to provide such guidance. The hood and jack are now in the relation shown in FIG. 2. Having reached such stage of partial insertion, the upward driving of the jack is continued until the bottoms of the jack's ribs clear the lower ends of the slots 55 in the hood. At this point, the outer surfaces 62 of such ribs are out of contact with the sidewalls 37 of the hood so as to be unable any longer to hold them spread apart. As a result, such walls are driven towards each other under the resilient force produce by their initial deflection until the inward movement of such walls is stopped by their coming into contact with the exterior surface areas 61 on the transversely opposite sides of the jack's housing. Such restoration of the hood's walls to close to their original positions causes the ribs 60 to enter and be received into the slots 55 in the hood to render the jack and hood snap-fitted together.

When so snap-fitted, the jack 23 cannot be casually dislodged from the hood even when the forward end of the latter is separated from connector 21. Accordingly, it is not required in order to prevent such dislodgement for the forward end of the hood to be fastened down on connector 21 such that the connector's front flange 25 blocks the jack from sliding out of the hood.

Preferably but not necessarily, when the resilient restoration movement of the hood's sidewalls 37 is stopped by their coming into contact with the jack's exterior surface areas 61, the hood's sidewalls are sill under residual resilient strain so as to press with some resilient force against the jack's housing. In this wise, the hood imposes on the jack a friction force tending to prevent any movement thereof within the hood which any clearances between the jack's ribs 60 and the hood slots 55 might otherwise allow. Thus, when such friction force is provided, it is not necessary, in order to maintain the jack fixedly positioned in relation to the hood, for there to be minimal clearances between the jack ribs and the hood slots, and for those elements to accordingly have tight manufacturing tolerances which are expensive.

With the jack being frictionally held in position as described within the hood, the outer surfaces 62 of the jack's ribs 60 will, due to the aforementioned thickness of those ribs, be exactly or approximately flush with the outer surfaces of the sidewalls 37 of the hood. To have a rib thickness yielding such flush relationship is advantageous because it maximizes the ability of the ribs to retain the jack in the hood in the presence of accidental forces tending to separate them while, concurrently, the ribs do not project substantially outward of the hood so as to, in effect, increase the transverse dimension of the adapter 20 and thereby cause difficulty in mounting it on a standard adapter block.

If, while the jack is snap-fitted to the hood, it is desired to separate the former from the latter when the hood is separated from connector 21, this can be done by manually spreading apart the sidewalls 37 of the hood and by exerting finger pressure on the front of the jack to drive it downward out the hood. Such removal of the jack from the hood is aided by the bevel faces 64 which are on the bottom of the jack's ribs 60, and which operate under such finger pressure to tend to wedge those sidewalls 37 apart.

Figure 3:
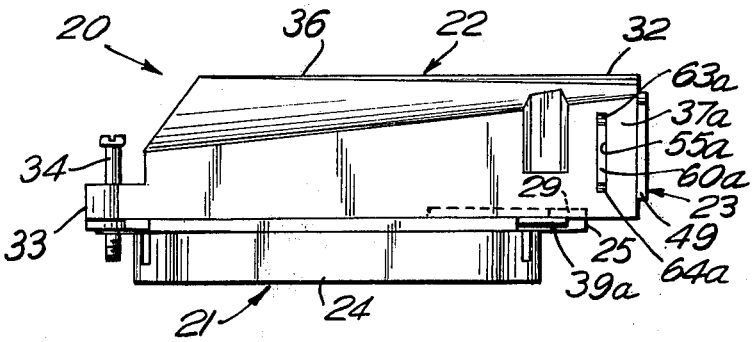
FIG. 3 is a front elevation of the FIG. 1 adapter in fully assembled condition for use.
Figure 4:
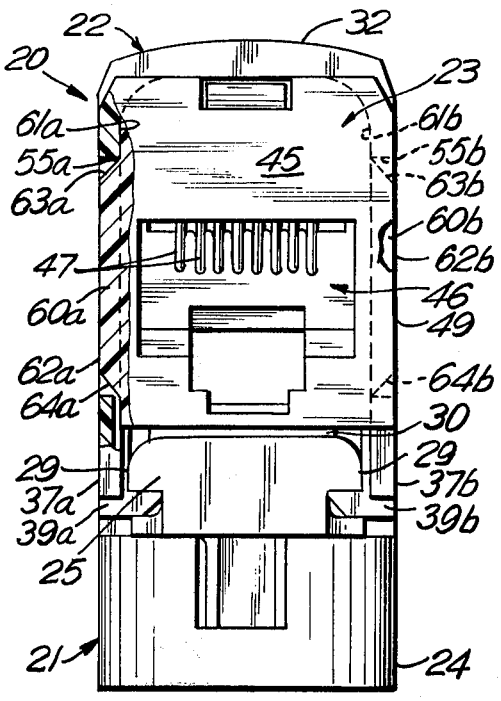
FIG. 4 is a right side elevation of the FIG. 3 adapter, looking towards the front face of its jack and into the plug-receiving passage of the jack.

When the jack has been snap-fitted into the hood as described above, the assembly of adapter 20 is completed by positioning the hood 22 on connector 21 such that the hood's tabs 39 engage with the connector's shoulders 29 and the adapter is otherwise in the condition shown in FIG. 3.

As mentioned, the described improvement in structure for fitting the jack to the hood of an electrical telecommunications adapter of the kind disclosed provides the advantage of permitting the widening of the plug receiving passage of the jack to accommodate more spring contacts therein without incurring any disadvantage consequent on such widening. Other advantages provided by such improved structure are, without restriction, as follows. On occasions when it is necessary to separate the jack and hood of the adapter from its connector in order to do work on the internal wiring of the adapter, the jack will, by virtue of such improved structure, be retained in the forward end of the hood in fixed position with respect thereto (rather than having a tendency to slide out of the hood as was typical of the prior art adapter) so as to avoid the inconvenience of having a jack element which was movable in relation to the hood and, therefore, made work on the adapter's internal wiring more difficult. Further, the improved structure is compatible with adapters already installed in the sense that, by merely replacing the old hood and jack of such adapter with a hood and jack embodying the improved structure, the adapter can be retro-fitted to receive the eight-contact connecting plug of modern key telephone sets. Still further, since the improved structure obtains the snap-fitting of the jack to the hood by the use of a property already intrinisic to the hood, namely the resilience of its sidewalls, changeover from the old style mode of securing the jack to the hood to the improved structure can be made at very little expense and with minimum change in the facilities for manufacturing the jack and hood of the adapter.

DETAILS OF CONSTRUCTION

As stated, the connector 21 is a commercially avaiable connector. The hood may be made of polycarbonate synthetic resin (e.g., LEXAN®). The longitudinal horizontal dimension of the hood from its back end 33 to its front opening 38 may be about 3.6 inches, other approximate appropriate dimensions of the hood and jack being available from scaling of the drawings hereof using such specified dimension as a reference dimension.

The above-described embodiment of the improvement hereof being exemplary, only, additions thereto, omissions therefrom and modifications thereof can be made without departing from the spirit of the invention. Accordingly, the invention is not to be considered as limited save as is consonant with the recitals of the following claims.

What is claimed is:

1. In an electrical telecommunications adatpter for coupling the terminating plug of a telephone set to contacts in turn coupled to the wires of a distribution cable, said adapter comprising:

(a) a longitudinally elongated electrical multi-pin connector horizontally disposed in its longitudinal direction, and the pins of which are adapted to be coupled with said contacts.

(b) a hood disposed over said connector and of transverse vertical cross-sectional upside down "U" shape so as to have an interior open at the bottom and to be enclosed by a top wall and transversely spaced resilient vertical sidewalls, all of said walls being portions of said hood which longitudinally extend to a forward end thereof to terminate at a front opening therefor of said shape; and (c) a jack for receiving said plug in a passage formed in said jack, said jack including contacts at the rear of said passage for respectively engaging with contacts in said plug, and said jack also including a housing containing said passage and said contacts therein and having longitudinally extending vertical surface areas on transversely opposite sides thereof, said housing being adapted to be disposed in the forward end of said hood at least partly to the rear of said opening with said surface areas of said housing being enclosed by said sidewalls of said hood;

the improvement in which:

(d) said jack housing has projections thereon which are adapted to be disposed within and above the bottom of said hood, rearward of said opening, and which extend transversely outward of said surface areas of said housing;

(e) said sidewalls of said hood have formed therein receptacles disposed above the hood's bottom and within which said projections are receivable; and (f) said jack when separated from said hood is insertable therein by wedging said jack upward into said hood to produce a transverse resilient spreading of said hood's sidewalls until said projections have entered said receptacles and, thereafter, a resilient restoration of said sidewalls towards each other so as to produce a snap-fitting together of jack and hood.

2. The improvement according to claim 1 in which, when said jack housing is in said hood, said hood's sidewalls are under residual resilient strain to press inwardly on said housing.

3. The improvement according to claim 1 in which said receptacles in said hood are vertical slots passing transversely through said hood's sidewalls and having lower ends above the hood's bottom, and in which said projections on said hood are vertical ribs formed on its transversely opposite sides and receivable in said slots.

4. The improvement according to claim 3 in which, when said jack housing is in said hood, said hood's sidewalls are in contact with said surface areas of said housing, and said ribs project transversely outward from said surface areas by an amount approximately equal to the thickness of said sidewalls of said slots.

5. The improvement according to claim 3 or claim 4 in which said ribs have thereon inclined faces at the upper ends thereof for wedging apart said resilient sidewalls of said hood in the course of insertion therein of said jack.

6. The improvement according to claim 1 in which said hood's sidewalls have grooves formed on the insides thereof and extending vertically between said receptacles and said hood's bottom, said grooves being adapted to guide said projections on said jack into said receptacles in the course of said jack's insertion into said hood.

7. The improvement according to claim 6 in which the inner surfaces of said grooves at the bottoms thereof have surface areas inclined to the vertical so as to extend downward and transversely outward to the bottom openings of said grooves to thereby impart to the transverse width of said grooves a taper which is downwardly divergent, said inclined surface areas being adapted to guide said jack in the course of its insertion in said hood so as to transversely center said jack therewithin.

8. The improvement according to claim 1 in which said jack has at least eight spring contacts in said passage at the rear thereof.

9. The improvement according to claim 1 in which said vertical surface areas on the transversely opposite sides of said jack housing are, over the longitudinal extent of said plug-receiving passage from its front to said contacts therein, free of any indentation for retaining therein part of said hood and substantially diminishing over such extent the transverse thickness outward of said passage of said housing.

10. In an electrical telecommunications adapter for coupling the terminating plug of a telephone set to contacts in turn coupled to the wires of a distribution cable, said adapter comprising:

(a) an electrical multi-pin connector horizontally disposed in its longitudinal direction, and the pins of which are adapted to be coupled to said contacts;

(b) a hood disposed over said connector and of transverse vertical cross-sectional upside down "U" shape so as to have an interior open at the bottom and to be enclosed by a top wall and transversely spaced resilient vertical sidewalls, all of said walls being portions of said hood which longitudinally extend to a forward end thereof to terminate at a front opening therefor of said shape; and (c) a jack for receiving said plug in a passage formed in said jack, said jack including contacts at the rear of said passage for respectively engaging with contacts in said plug, and said jack also including a housing containing said passage and said contacts therein and having longitudinally extending vertical surface areas on transversely opposite sides thereof, said housing being adapted to be disposed in the forward end of said hood at least partly to the rear of said opening with said surface areas of said housing being enclosed by said sidewalls of said hood;

the improvement in which (d) said jack housing has vertical ribs formed on its transversely opposite sides rearward of the front of said housing and above the bottom thereof;

(e) said sidewalls of said hood have vertical slots passing transversely therethrough rearward of said opening and above the bottom of said hood, said slots being adapted to receive said jack's ribs thereinto;

(f) said vertical surface areas on the transversely opposite sides of said jack housing are, over the longitudinal extent of said plug—receiving passage from its front to said contacts therein, free of any indentation for retaining part of said hood and substantially diminishing over such extent the transverse thickness outward of said passage of said housing, and (g) said jack when separated from said hood is insertable therein by wedging said jack upward into said hood to product a transverse resilient spreading of said hood's sidewalls until said ribs have entered said slots, and thereafter, a resilient restoration of said sidewalls towards each other so as to produce a snap-fitting together of said jack and hood.

* * * * *